US011926885B2

(12) United States Patent
Wang et al.

(10) Patent No.: US 11,926,885 B2
(45) Date of Patent: Mar. 12, 2024

(54) HIGH-PLASTICITY RAPIDLY-DEGRADABLE MG-LI-GD-NI ALLOY AND PREPARATION METHOD THEREOF

(71) Applicant: Chongqing University, Chongqing (CN)

(72) Inventors: Jingfeng Wang, Chongqing (CN); Jie Ren, Chongqing (CN); Kai Ma, Chongqing (CN); Chaoneng Dai, Chongqing (CN)

(73) Assignee: Chongqing University, Chongqing (CN)

( * ) Notice: Subject to any disclaimer, the term of this patent is extended or adjusted under 35 U.S.C. 154(b) by 0 days.

(21) Appl. No.: 17/836,888

(22) Filed: Jun. 9, 2022

(65) Prior Publication Data

US 2023/0235430 A1 Jul. 27, 2023

(30) Foreign Application Priority Data

Jan. 21, 2022 (CN) ..... 202210074228.X

(51) Int. Cl.
*C22C 23/00* (2006.01)
*C22C 1/02* (2006.01)
*C22F 1/06* (2006.01)

(52) U.S. Cl.
CPC ..... *C22C 23/00* (2013.01); *C22C 1/02* (2013.01); *C22F 1/06* (2013.01)

(58) Field of Classification Search
CPC ..... C22C 23/00; C22C 1/02; C22F 1/06
See application file for complete search history.

(56) References Cited

FOREIGN PATENT DOCUMENTS

CN 108085548 A * 5/2018
CN 109161770 A * 1/2019 ..... C22C 1/03

OTHER PUBLICATIONS

CN-108085548-A, Yuan et al., machine translation (Year: 2018).*
CN-109161770-A, Chen et al., machine translation (Year: 2019).*

* cited by examiner

*Primary Examiner* — John A Hevey
(74) *Attorney, Agent, or Firm* — Bochner PLLC; Andrew D. Bochner

(57) ABSTRACT

The present disclosure provides a high-plasticity rapidly-degradable Mg—Li—Gd—Ni alloy, including the following chemical elements by mass percentage: 1.0-10.0% of Gd, 0.2-2.0% of Ni, 5.5-10% of Li, and the rest of Mg and inevitable impurities. The impurities have a total content less than or equal to 0.3%. The present disclosure further provides a preparation method of the high-plasticity rapidly-degradable Mg—Li—Gd—Ni alloy. The high-plasticity rapidly-degradable Mg—Li—Gd—Ni alloy provided by the present disclosure constructs an α-Mg+β-Li dual-phase matrix structure by introducing β-Li with a body-centered cubic (BCC) structure with relatively more slip systems to improve plasticity of the alloy, then adds a certain amount of Gd element to weaken texture and promote non-basal plane slip, and further improves plasticity. In addition, by introducing the high-potential Ni-containing LPSO phase, a large potential difference with α-Mg and β-Li is formed to increase the degradation performance.

8 Claims, 2 Drawing Sheets

HIGH-PLASTICITY RAPIDLY-DEGRADABLE MG-LI-GD-NI ALLOY AND PREPARATION METHOD THEREOF

CROSS REFERENCE TO RELATED APPLICATION

This patent application claims the benefit and priority of Chinese Patent Application No. 202210074228.X, filed on Jan. 21, 2022, the disclosure of which is incorporated by reference herein in its entirety as part of the present application.

TECHNICAL FIELD

The present disclosure belongs to the technical field of metal material processing, and in particular, to a high-plasticity rapidly-degradable Mg—Li—Gd—Ni alloy and a preparation method thereof.

BACKGROUND ART

In recent years, unconventional shale gas exploration and development technologies outside China have made breakthroughs, and oil and gas production has increased rapidly, which has a major impact on the international gas market and the world energy pattern. The world's major resource countries have increased their efforts in shale gas exploration and development. In development of unconventional oil and gas reservoirs, fracturing reformation is an important measure to improve single well production. The key components in fracturing reformation technology are fracturing tools, including fracturing balls, bridge plugs, and sliding sleeves. The traditional bridge plug needs to be drilled out after fracturing, which is time-consuming and labor-intensive, and increases the cost. Therefore, a new soluble fracturing bridge plug is required, which degrades itself after fracturing.

Mg alloys have the characteristics of low density, high specific strength and specific stiffness, and easy machining, and can be used as candidate materials for soluble fracturing tools combined with the fast degradation rate. The soluble Mg alloys currently studied, such as Mg—Al—Zn—Cu and Mg—Zn—Y—Cu, have low degradation rate and plasticity, while the sealing ring and slip required for the soluble bridge plug will have large deformation during fracturing, so it is necessary to study a high-plasticity rapidly-degradable Mg alloy to replace the traditional fracturing material.

The patent No. 201910335132.2 discloses a fast-dissolving high-strength and high-elongation Al—Mg alloy and a preparation method thereof, which are specifically composed of the following elements by mass percentage: 1.0-22.0% of Gd, 0.001-5.0% of Y, 0.001-10% of Al, 0.001-5.0% of Zn, 0.01-1.0% of Zr, 0.0001-1.0% of Sc, 0.01-10.0% of Cu, 0.01-3.0% of Li, 0.01-3.0% of Ni, 0.01-3.0% of Ga, 0.01-3.0% of In, and the rest of Mg and impurity elements. Li, Ni, Ga, and In have a total content of 0.1-6.0%. The fast-dissolving high-strength and high-elongation Al—Mg alloy can quickly react and dissolve with a water-soluble medium, and also has mechanical strength properties of high strength and high elongation. However, the compositions of the Al—Mg alloy are complex, resulting in high production cost, and the problem that the elongation is not ideal still exists.

SUMMARY

The present disclosure aims to solve one of the technical problems in the related art at least to a certain extent. In view of this, a main objective of the present disclosure is to provide a high-plasticity rapidly-degradable Mg—Li—Gd—Ni alloy, which aims to solve the technical problems of high production cost and poor elongation caused by complex compositions of an existing Mg alloy. The present disclosure further provides a preparation method of the high-plasticity rapidly-degradable Mg—Li—Gd—Ni alloy.

The objective of the present disclosure is achieved by the following technical solutions.

In a first aspect, a high-plasticity rapidly-degradable Mg—Li—Gd—Ni alloy includes the following chemical elements by mass percentage: 1.0-10.0% of Gd, 0.2-2.0% of Ni, 5.5-10% of Li, and the rest of Mg and inevitable impurities. The impurities have a total content less than or equal to 0.3%.

Preferably, the high-plasticity rapidly-degradable Mg—Li—Gd—Ni alloy may include the following chemical elements by mass percentage: 6.0% of Gd, 8.0% of Li, 1.5% of Ni, and the rest of Mg and inevitable impurities. The impurities may have a total content less than or equal to 0.3%.

Preferably, the high-plasticity rapidly-degradable Mg—Li—Gd—Ni alloy may include the following chemical elements by mass percentage: 6.0% of Gd, 8.0% of Li, 1.0% of Ni, and the rest of Mg and inevitable impurities. The impurities may have a total content less than or equal to 0.3%.

Preferably, the high-plasticity rapidly-degradable Mg—Li—Gd—Ni alloy may include the following chemical elements by mass percentage: 6.0% of Gd, 8.0% of Li, 0.5% of Ni, and the rest of Mg and inevitable impurities. The impurities may have a total content less than or equal to 0.3%.

In a second aspect, a preparation method of the high-plasticity rapidly-degradable Mg—Li—Gd—Ni alloy according to the above items includes the following technical steps:

A) batching, smelting, and cooling an industrial pure Mg ingot, a Mg—Li master alloy, a Mg—Gd master alloy, and a Mg—Ni master alloy according to above mass fractions to obtain an as-cast alloy;

B) performing pre-extrusion heat treatment, air cooling, and machining on the as-cast alloy obtained in step A) to obtain an extrusion ingot; and C) performing pre-heating treatment and extrusion forming on the extrusion ingot in step B) to obtain an extruded Mg—Li—Gd—Ni alloy rod.

Preferably, the preparation method may further include pre-treatment. A process of pre-treatment may include polishing surfaces of the industrial pure Mg ingot, the Mg—Li master alloy, the Mg—Gd master alloy, and the Mg—Ni master alloy, placing the polished industrial pure Mg ingot, Mg—Li master alloy, Mg—Gd master alloy, and Mg—Ni master alloy in industrial alcohol in turn, and then placing the polished industrial pure Mg ingot, Mg—Li master alloy, Mg—Gd master alloy, and Mg—Ni master alloy in an ultrasonic cleaner for cleaning.

Preferably, a process of step A) may specifically include: placing the pure Mg ingot, the Mg—Li master alloy, the Mg—Gd master alloy, and the Mg—Ni master alloy in a crucible based on a proportion of the above mass fractions, placing the crucible in a vacuum induction furnace, vacuumizing to $5.0\times10^{-1}$ Pa, heating to 730° C. under protection of an argon gas until complete melting, performing heat preservation for 10 min, stirring evenly, and scraping away scum on a surface of a melt to obtain an alloy melt; and then closing the vacuum induction furnace, such that the alloy melt is cooled with a furnace temperature of the vacuum induction furnace to obtain the as-cast alloy.

Preferably, a process of step B) may specifically include: placing the as-cast alloy obtained in step A) in a 200° C. heat treatment furnace for pre-extrusion heat treatment for 2 h, performing air cooling, and performing turning machining on the air-cooled as-cast alloy to obtain the extrusion ingot with a diameter of 80 mm and a height of 70 mm.

Preferably, the pre-heating treatment may be performed at 260° C. for 20 min.

Preferably, the extrusion forming may be performed with an extrusion ratio of (28-50):1 at 1-3 m/min and 200-300° C.

Compared with the prior art, the present disclosure at least has the following advantages:

1) The high-plasticity rapidly-degradable Mg—Li—Gd—Ni alloy provided by the present disclosure constructs an α-Mg+β-Li dual-phase matrix structure by introducing β-Li with a body-centered cubic (BCC) structure with relatively more slip systems into α-Mg to improve plasticity of the alloy, then adds a certain amount of Gd element to a Mg—Li alloy to weaken texture and promote non-basal plane slip, and improves the plasticity of the alloy through combination of various plasticizing methods such as a β-Li phase with good plasticity and formation of a long-period stacking ordered (LPSO) toughness phase. In addition, by introducing a high-potential Ni-containing LPSO phase, a large potential difference formed with α-Mg and β-Li accelerates occurrence of galvanic corrosion and increases degradation performance of the alloy.
2) The preparation method of the high-plasticity rapidly-degradable Mg—Li—Gd—Ni alloy provided by the present disclosure has simple and readily available raw materials, no pollution to the environment, and simple and green process, and is easy to operate and control, and the used process equipment (such as vacuum induction furnace and extruder) is conventional equipment, which is convenient to reduce the production cost and realize industrial application.

BRIEF DESCRIPTION OF THE DRAWINGS

In order to illustrate the specific embodiments of the present disclosure more clearly, accompanying drawings required for the description of the specific embodiments or the prior art will be briefly described below.

DETAILED DESCRIPTION OF THE EMBODIMENTS

Figure 1:
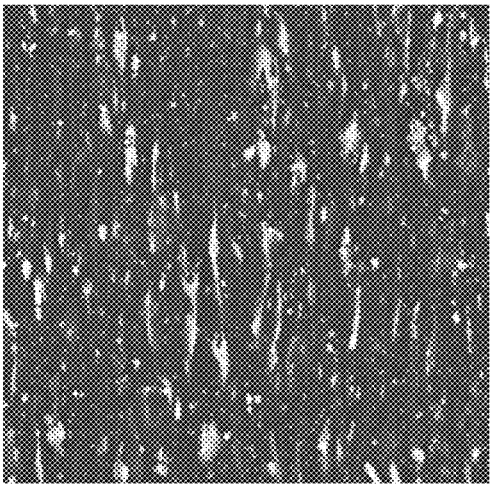
FIG. 1 is a scanning electron microscope (SEM) diagram of a high-plasticity rapidly-degradable Mg—Li—Gd—Ni alloy provided by Embodiment 5 of the present disclosure.

The present disclosure is further described in detail below in conjunction with the accompanying drawings and specific embodiments. The following embodiments are only illustrative and not restrictive, and cannot be used to limit the protection scope of the present disclosure.

When an amount, concentration, or other value or parameter is expressed in the form of a range, a preferred range, or preferred upper and lower limit values, it should be understood as being equivalent to specifically disclosing any range combining any pair of upper range or preferred values with any lower range or preferred values, regardless of whether or not the range is specifically disclosed. Unless otherwise indicated, numerical range values set forth herein are inclusive of the endpoints of the range, and all integers and fractions within that range.

All percentages, parts, and ratios herein are by weight unless otherwise indicated.

The materials, methods, and embodiments herein are illustrative and should not be construed as limiting unless specifically stated.

Pure Mg ingots, Mg—Li master alloys, Mg—Gd master alloys, and Mg—Ni master alloys used in the following embodiments of the present disclosure can all be obtained through commercial channels.

The model of a SEM used in the following embodiments of the present disclosure is JSM-7800F.

In the following embodiments of the present disclosure, the Mg ingot has a purity ≥99.999%. The Mg—Li master alloy, the Mg—Gd master alloy, and the Mg—Ni master alloy are collectively referred to as the Mg master alloy, and Li, Gd, and Ni in the Mg master alloy respectively account for 20-30% of a total mass of the Mg master alloy. Specifically, the Mg—Li master alloy selected in the present disclosure is Mg-20Li, the Mg—Gd master alloy is Mg-30Gd, and the Mg—Ni master alloy is Mg-30Ni.

A mechanical properties test of alloys in the following embodiments of the present disclosure is according to "GB/T 16865-2013 Test pieces and method for tensile test for wrought aluminum and magnesium alloys products".

A degradation rate test is according to "JB/T 7901-1999 Metal materials-Uniform corrosion-Methods of laboratory immersion testing".

The study on the properties of alloys with different component selections in the present disclosure determines the limit of the alloy content in the Mg alloy of the present disclosure.

By introducing a β-Li phase with a BCC structure with relatively more slip systems into an α-Mg phase, a dual-phase structure is constructed to improve the plasticity of the Mg alloy.

A Li element has a content of 5.5-10.0% to ensure the existence of α-Mg+β-Li dual phase. If an introduction amount of the Li element is less than 5.5%, the alloy does not have the β-Li phase, and the plasticity is low, and if it exceeds 10%, the alloy has only β-Li, which will significantly reduce the strength of the alloy.

By adding a certain amount of Gd element to the Mg—Li alloy, a texture is weakened, non-basal plane slip is promoted, and the plasticity of the Mg alloy is improved.

A Gd element has a content of 1.0-10.0% to ensure the plasticity of the alloy. If an introduction amount of the Gd element is less than 1.0%, the strength of the alloy is low, and if it exceeds 10%, the plasticity of the alloy will be reduced.

By introducing a high-potential Ni element into the alloy to form a Ni-containing LPSO phase, a large potential difference formed with α-Mg and β-Li accelerates occurrence of galvanic corrosion and increases degradation performance of the alloy.

A content of Ni is selected to be 0.2-2.0% to improve the degradation performance of the alloy on the basis of ensuring that the mechanical properties of the alloy are not affected. The addition amount of Ni is less than 0.2%, which cannot meet the degradation performance. When the content is greater than 2.0%, the plasticity of the alloy will be reduced.

The present disclosure studies alloy properties selected by each step and process parameter in the preparation method, and determines the limitations of the preparation steps and process parameters in the alloy of the present disclosure.

In the preparation method of the present disclosure, in step C), the extrusion forming is performed with an extrusion ratio of (28-50):1 at 1-3 m/min and 200-300° C. to ensure complete recrystallization of β-Li. If the extrusion temperature is lower than 200° C., the extrusion ratio is less than 28, and the extrusion speed is less than 1 m/min, the matrix is not completely recrystallized, and the plasticity is low. If the extrusion temperature is higher than 300° C., the extrusion ratio is greater than 50, and the extrusion speed is greater than 3 m/min, there will be defects such as burrs, blackening, and delithiation on the surface of the extrusion alloy.

The proportions of elements in the alloys in the present disclosure and various process technical parameters in the preparation method are found through experiments and are optimal as the claimed comprehensive technical results can be obtained. If the element ratio is violated, the properties of the alloy deteriorate, become unstable, and the composite effect is not achieved.

Embodiment 1

A high-plasticity rapidly-degradable Mg—Li—Gd—Ni alloy includes the following chemical elements by mass percentage: 6.0% of Gd, 0.5% of Ni, 8% of Li, and the rest of Mg and inevitable impurities. The impurities have a total content less than or equal to 0.3%.

The present disclosure further provides a preparation method of the high-plasticity rapidly-degradable Mg—Li—Gd—Ni alloy, including the following steps.

1) Pre-treatment: surfaces of an industrial pure Mg ingot, a Mg—Li master alloy, a Mg—Gd master alloy, and a Mg—Ni master alloy are polished to remove an oxide layer from the surfaces, and the polished industrial pure Mg ingot, Mg—Li master alloy, Mg—Gd master alloy, and Mg—Ni master alloy are placed in industrial alcohol in turn, and then placed in an ultrasonic cleaner for cleaning.
2) The pre-treated pure Mg ingot, Mg—Li master alloy, Mg—Gd master alloy, and Mg—Ni master alloy are placed in a crucible based on a proportion of above mass fractions. Then the crucible is placed in a vacuum induction furnace. Vacuumizing is performed to $5.0\times10^{-1}$ Pa. Heating is performed to 730° C. under protection of an argon gas until complete melting. Heat preservation is performed for 10 min. A mixture is stirred evenly. Scum on a surface of a melt is scraped away to obtain an alloy melt. Then the vacuum induction furnace is closed, such that the alloy melt is cooled with a furnace temperature of the vacuum induction furnace to obtain an as-cast alloy.
3) The as-cast alloy obtained in step 2) is placed in a 200° C. heat treatment furnace for pre-extrusion heat treatment for 2 h. Air cooling is performed. Turning machining is performed on the air-cooled as-cast alloy to obtain an extrusion ingot with a diameter of 80 mm and a height of 70 mm.
4) The extrusion ingot in step 3) is subjected to preheating treatment at 260° C. for 20 min, and then subjected to extrusion forming in an extruder with an extrusion temperature of 260° C., an extrusion ratio of 28:1, and an extrusion speed of 1.5 m/min to obtain an extruded Mg—Li—Gd—Ni alloy rod.

In the present embodiment, the properties of the prepared high-plasticity rapidly-degradable Mg—Li—Gd—Ni alloy are tested, and the results are as follows: the alloy has a tensile strength of 200 MPa, a yield strength of 141 MPa, an elongation of 35.9%, and a degradation rate of 34 mg/cm$^2$/h in a 3 wt % KCl solution at 93° C.

Embodiment 2

A high-plasticity rapidly-degradable Mg—Li—Gd—Ni alloy includes the following chemical elements by mass percentage: 6.0% of Gd, 1.0% of Ni, 8% of Li, and the rest of Mg and inevitable impurities. The impurities have a total content less than or equal to 0.3%.

The present disclosure further provides a preparation method of the high-plasticity rapidly-degradable Mg—Li—Gd—Ni alloy, including the following steps.

1) Pre-treatment: surfaces of an industrial pure Mg ingot, a Mg—Li master alloy, a Mg—Gd master alloy, and a Mg—Ni master alloy are polished to remove an oxide layer from the surfaces, and the polished industrial pure Mg ingot, Mg—Li master alloy, Mg—Gd master alloy, and Mg—Ni master alloy are placed in industrial alcohol in turn, and then placed in an ultrasonic cleaner for cleaning.
2) The pre-treated pure Mg ingot, Mg—Li master alloy, Mg—Gd master alloy, and Mg—Ni master alloy are placed in a crucible based on a proportion of above mass fractions. Then the crucible is placed in a vacuum induction furnace. Vacuumizing is performed to $5.0\times10^{-1}$ Pa. Heating is performed to 730° C. under protection of an argon gas until complete melting. Heat preservation is performed for 10 min. A mixture is stirred evenly. Scum on a surface of a melt is scraped away to obtain an alloy melt. Then the vacuum induction furnace is closed, such that the alloy melt is cooled with a furnace temperature of the vacuum induction furnace to obtain an as-cast alloy.
3) The as-cast alloy obtained in step 2) is placed in a 200° C. heat treatment furnace for pre-extrusion heat treatment for 2 h. Air cooling is performed. Turning machining is performed on the air-cooled as-cast alloy to obtain an extrusion ingot with a diameter of 80 mm and a height of 70 mm.
4) The extrusion ingot in step 3) is subjected to preheating treatment at 260° C. for 20 min, and then subjected to extrusion forming in an extruder with an extrusion temperature of 260° C., an extrusion ratio of 28:1, and an extrusion speed of 1 m/min to obtain an extruded Mg—Li—Gd—Ni alloy rod.

In the present embodiment, the properties of the prepared high-plasticity rapidly-degradable Mg—Li—Gd—Ni alloy are tested, and the results are as follows: the alloy has a tensile strength of 203 MPa, a yield strength of 137 MPa, an elongation of 36.3%, and a degradation rate of 53 mg/cm$^2$/h in a 3 wt % KCl solution at 93° C.

Embodiment 3

A high-plasticity rapidly-degradable Mg—Li—Gd—Ni alloy includes the following chemical elements by mass percentage: 6.0% of Gd, 1.5% of Ni, 8% of Li, and the rest of Mg and inevitable impurities. The impurities have a total content less than or equal to 0.3%.

The present disclosure further provides a preparation method of the high-plasticity rapidly-degradable Mg—Li—Gd—Ni alloy, including the following steps.

1) Pre-treatment: surfaces of an industrial pure Mg ingot, a Mg—Li master alloy, a Mg—Gd master alloy, and a Mg—Ni master alloy are polished to remove an oxide layer from the surfaces, and the polished industrial pure Mg ingot, Mg—Li master alloy, Mg—Gd master alloy, and Mg—Ni master alloy are placed in industrial alcohol in turn, and then placed in an ultrasonic cleaner for cleaning.
2) The pre-treated pure Mg ingot, Mg—Li master alloy, Mg—Gd master alloy, and Mg—Ni master alloy are placed in a crucible based on a proportion of above mass fractions. Then the crucible is placed in a vacuum induction furnace. Vacuumizing is performed to $5.0\times10^{-1}$ Pa. Heating is performed to 730° C. under protection of an argon gas until complete melting. Heat preservation is performed for 10 min. A mixture is stirred evenly. Scum on a surface of a melt is scraped away to obtain an alloy melt. Then the vacuum induction furnace is closed, such that the alloy melt is cooled with a furnace temperature of the vacuum induction furnace to obtain an as-cast alloy.
3) The as-cast alloy obtained in step 2) is placed in a 200° C. heat treatment furnace for pre-extrusion heat treatment for 2 h. Air cooling is performed. Turning machining is performed on the air-cooled as-cast alloy to obtain an extrusion ingot with a diameter of 80 mm and a height of 70 mm.
4) The extrusion ingot in step 3) is subjected to preheating treatment at 260° C. for 20 min, and then subjected to extrusion forming in an extruder with an extrusion temperature of 260° C., an extrusion ratio of 28:1, and an extrusion speed of 1 m/min to obtain an extruded Mg—Li—Gd—Ni alloy rod.

In the present embodiment, the properties of the prepared high-plasticity rapidly-degradable Mg—Li—Gd—Ni alloy are tested, and the results are as follows: the alloy has a tensile strength of 202 MPa, a yield strength of 145 MPa, an elongation of 39%, and a degradation rate of 87 mg/cm$^2$/h in a 3 wt % KCl solution at 93° C.

Embodiment 4

A high-plasticity rapidly-degradable Mg—Li—Gd—Ni alloy includes the following chemical elements by mass percentage: 3.0% of Gd, 0.5% of Ni, 8.0% of Li, and the rest of Mg and inevitable impurities. The impurities have a total content less than or equal to 0.3%.

The present disclosure further provides a preparation method of the high-plasticity rapidly-degradable Mg—Li—Gd—Ni alloy, including the following steps.

1) Pre-treatment: surfaces of an industrial pure Mg ingot, a Mg—Li master alloy, a Mg—Gd master alloy, and a Mg—Ni master alloy are polished to remove an oxide layer from the surfaces, and the polished industrial pure Mg ingot, Mg—Li master alloy, Mg—Gd master alloy, and Mg—Ni master alloy are placed in industrial alcohol in turn, and then placed in an ultrasonic cleaner for cleaning.
2) The pre-treated pure Mg ingot, Mg—Li master alloy, Mg—Gd master alloy, and Mg—Ni master alloy are placed in a crucible based on a proportion of above mass fractions. Then the crucible is placed in a vacuum induction furnace. Vacuumizing is performed to $2.5\times10^{-1}$ Pa. Heating is performed to 730° C. under protection of an argon gas until complete melting. Heat preservation is performed for 10 min. A mixture is stirred evenly. Scum on a surface of a melt is scraped away to obtain an alloy melt. Then the vacuum induction furnace is closed, such that the alloy melt is cooled with a furnace temperature of the vacuum induction furnace to obtain an as-cast alloy.
3) The as-cast alloy obtained in step 2) is placed in a 200° C. heat treatment furnace for pre-extrusion heat treatment for 2 h. Air cooling is performed. Turning machining is performed on the air-cooled as-cast alloy to obtain an extrusion ingot with a diameter of 80 mm and a height of 70 mm.
4) The extrusion ingot in step 3) is subjected to preheating treatment at 260° C. for 20 min, and then subjected to extrusion forming in an extruder with an extrusion temperature of 260° C., an extrusion ratio of 50:1, and an extrusion speed of 1.5 m/min to obtain an extruded Mg—Li—Gd—Ni alloy rod.

In the present embodiment, the properties of the prepared high-plasticity rapidly-degradable Mg—Li—Gd—Ni alloy are tested, and the results are as follows: the alloy has a tensile strength of 207 MPa, a yield strength of 149 MPa, an elongation of 39%, and a degradation rate of 30 mg/cm$^2$/h in a 3 wt % KCl solution at 93° C.

Embodiment 5

A high-plasticity rapidly-degradable Mg—Li—Gd—Ni alloy includes the following chemical elements by mass percentage: 6.0% of Gd, 0.5% of Ni, 8.0% of Li, and the rest of Mg and inevitable impurities. The impurities have a total content less than or equal to 0.3%.

The present disclosure further provides a preparation method of the high-plasticity rapidly-degradable Mg—Li—Gd—Ni alloy, including the following steps.

1) Pre-treatment: surfaces of an industrial pure Mg ingot, a Mg—Li master alloy, a Mg—Gd master alloy, and a Mg—Ni master alloy are polished to remove an oxide layer from the surfaces, and the polished industrial pure Mg ingot, Mg—Li master alloy, Mg—Gd master alloy, and Mg—Ni master alloy are placed in industrial alcohol in turn, and then placed in an ultrasonic cleaner for cleaning.
2) The pre-treated pure Mg ingot, Mg—Li master alloy, Mg—Gd master alloy, and Mg—Ni master alloy are placed in a crucible based on a proportion of above mass fractions. Then the crucible is placed in a vacuum induction furnace. Vacuumizing is performed to $5.0\times10^{-1}$ Pa. Heating is performed to 730° C. under protection of an argon gas until complete melting. Heat preservation is performed for 10 min. A mixture is stirred evenly. Scum on a surface of a melt is scraped away to obtain an alloy melt. Then the vacuum induction furnace is closed, such that the alloy melt is cooled with a furnace temperature of the vacuum induction furnace to obtain an as-cast alloy.
3) The as-cast alloy obtained in step 2) is placed in a 200° C. heat treatment furnace for pre-extrusion heat treatment for 2 h. Air cooling is performed. Turning machining is performed on the air-cooled as-cast alloy to obtain an extrusion ingot with a diameter of 80 mm and a height of 70 mm.
4) The extrusion ingot in step 3) is subjected to preheating treatment at 260° C. for 20 min, and then subjected to extrusion forming in an extruder with an extrusion temperature of 260° C., an extrusion ratio of 50:1, and an extrusion speed of 1 m/min to obtain an extruded Mg—Li—Gd—Ni alloy rod.

In the present embodiment, the properties of the prepared high-plasticity rapidly-degradable Mg—Li—Gd—Ni alloy are tested, and the results are as follows: the alloy has a tensile strength of 207 MPa, a yield strength of 162 MPa, an elongation of 41.5%, and a degradation rate of 40 mg/cm$^2$/h in a 3 wt % KCl solution at 93° C.

Figure 4:
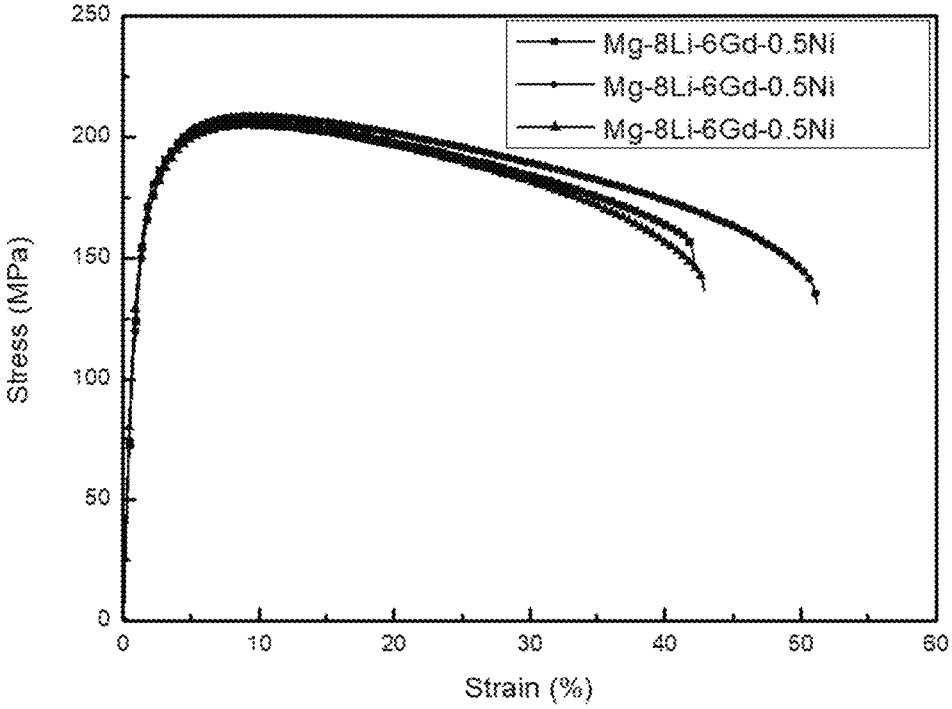
FIG. 4 is a mechanical property diagram of the high-plasticity rapidly-degradable Mg—Li—Gd—Ni alloy provided by Embodiments 5 to 7 of the present disclosure.

A SEM diagram of the high-plasticity rapidly-degradable Mg—Li—Gd—Ni alloy prepared by the present embodiment is shown in FIG. 1, and mechanical properties are shown in FIG. 4.

Embodiment 6

A high-plasticity rapidly-degradable Mg—Li—Gd—Ni alloy includes the following chemical elements by mass percentage: 6.0% of Gd, 1.0% of Ni, 8% of Li, and the rest of Mg and inevitable impurities. The impurities have a total content less than or equal to 0.3%.

The present disclosure further provides a preparation method of the high-plasticity rapidly-degradable Mg—Li—Gd—Ni alloy, including the following steps.

1) Pre-treatment: surfaces of an industrial pure Mg ingot, a Mg—Li master alloy, a Mg—Gd master alloy, and a Mg—Ni master alloy are polished to remove an oxide layer from the surfaces, and the polished industrial pure Mg ingot, Mg—Li master alloy, Mg—Gd master alloy, and Mg—Ni master alloy are placed in industrial alcohol in turn, and then placed in an ultrasonic cleaner for cleaning.
2) The pre-treated pure Mg ingot, Mg—Li master alloy, Mg—Gd master alloy, and Mg—Ni master alloy are placed in a crucible based on a proportion of above mass fractions. Then the crucible is placed in a vacuum induction furnace. Vacuumizing is performed to 5.0×10$^{-1}$ Pa. Heating is performed to 730° C. under protection of an argon gas until complete melting. Heat preservation is performed for 10 min. A mixture is stirred evenly. Scum on a surface of a melt is scraped away to obtain an alloy melt. Then the vacuum induction furnace is closed, such that the alloy melt is cooled with a furnace temperature of the vacuum induction furnace to obtain an as-cast alloy.
3) The as-cast alloy obtained in step 2) is placed in a 200° C. heat treatment furnace for pre-extrusion heat treatment for 2 h. Air cooling is performed. Turning machining is performed on the air-cooled as-cast alloy to obtain an extrusion ingot with a diameter of 80 mm and a height of 70 mm.
4) The extrusion ingot in step 3) is subjected to preheating treatment at 260° C. for 20 min, and then subjected to extrusion forming in an extruder with an extrusion temperature of 260° C., an extrusion ratio of 50:1, and an extrusion speed of 3 in/min to obtain an extruded Mg—Li—Gd—Ni alloy rod.

In the present embodiment, the properties of the prepared high-plasticity rapidly-degradable Mg—Li—Gd—Ni alloy are tested, and the results are as follows: the alloy has a tensile strength of 208 MPa, a yield strength of 143 MPa, an elongation of 47.5%, and a degradation rate of 63 mg/cm$^2$/h in a 3 wt % KCl solution at 93° C.

Figure 2:
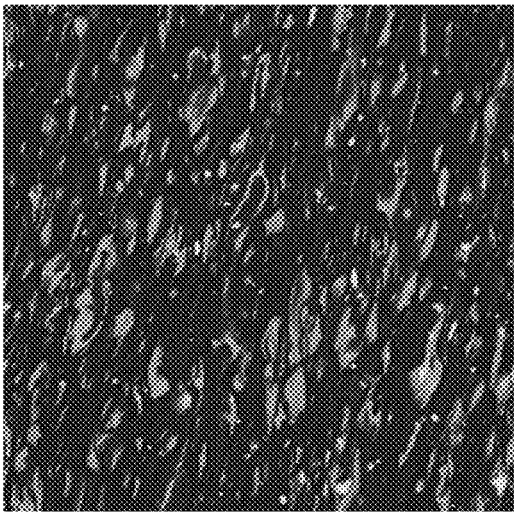
FIG. 2 is a SEM diagram of a high-plasticity rapidly-degradable Mg—Li—Gd—Ni alloy provided by Embodiment 6 of the present disclosure.

A SEM diagram of the high-plasticity rapidly-degradable Mg—Li—Gd—Ni alloy prepared by the present embodiment is shown in FIG. 2, and mechanical properties are shown in FIG. 4.

Embodiment 7

A high-plasticity rapidly-degradable Mg—Li—Gd—Ni alloy includes the following chemical elements by mass percentage: 6.0% of Gd, 1.5% of Ni, 8% of Li, and the rest of Mg and inevitable impurities. The impurities have a total content less than or equal to 0.3%.

The present disclosure further provides a preparation method of the high-plasticity rapidly-degradable Mg—Li—Gd—Ni alloy, including the following steps.

1) Pre-treatment: surfaces of an industrial pure Mg ingot, a Mg—Li master alloy, a Mg—Gd master alloy, and a Mg—Ni master alloy are polished to remove an oxide layer from the surfaces, and the polished industrial pure Mg ingot, Mg—Li master alloy, Mg—Gd master alloy, and Mg—Ni master alloy are placed in industrial alcohol in turn, and then placed in an ultrasonic cleaner for cleaning.
2) The pre-treated pure Mg ingot, Mg—Li master alloy, Mg—Gd master alloy, and Mg—Ni master alloy are placed in a crucible based on a proportion of above mass fractions. Then the crucible is placed in a vacuum induction furnace. Vacuumizing is performed to 5.0×10$^{-1}$ Pa. Heating is performed to 730° C. under protection of an argon gas until complete melting. Heat preservation is performed for 10 min. A mixture is stirred evenly. Scum on a surface of a melt is scraped away to obtain an alloy melt. Then the vacuum induction furnace is closed, such that the alloy melt is cooled with a furnace temperature of the vacuum induction furnace to obtain an as-cast alloy.
3) The as-cast alloy obtained in step 2) is placed in a 200° C. heat treatment furnace for pre-extrusion heat treatment for 2 h. Air cooling is performed. Turning machining is performed on the air-cooled as-cast alloy to obtain an extrusion ingot with a diameter of 80 mm and a height of 70 mm.
4) The extrusion ingot in step 3) is subjected to preheating treatment at 260° C. for 20 min, and then subjected to extrusion forming in an extruder with an extrusion temperature of 260° C., an extrusion ratio of 50:1, and an extrusion speed of 2 m/min to obtain an extruded Mg—Li—Gd—Ni alloy rod.

In the present embodiment, the properties of the prepared high-plasticity rapidly-degradable Mg—Li—Gd—Ni alloy are tested, and the results are as follows: the alloy has a tensile strength of 204 MPa, a yield strength of 142 MPa, an elongation of 42.5%, and a degradation rate of 79 mg/cm$^2$/h in a 3 wt % KCl solution at 93° C.

Figure 3:
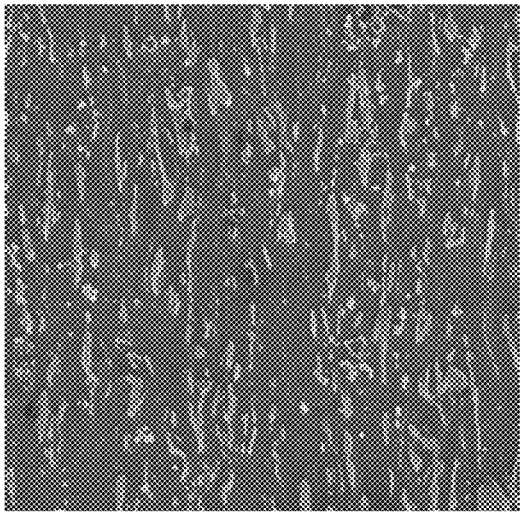
FIG. 3 is a SEM diagram of a high-plasticity rapidly-degradable Mg—Li—Gd—Ni alloy provided by Embodiment 7 of the present disclosure.

A SEM diagram of the high-plasticity rapidly-degradable Mg—Li—Gd—Ni alloy prepared by the present embodiment is shown in FIG. 3, and mechanical properties are shown in FIG. 4.

Embodiment 8

A high-plasticity rapidly-degradable Mg—Li—Gd—Ni alloy includes the following chemical elements by mass percentage: 6.0% of Gd, 0.5% of Ni, 6% of Li, and the rest of Mg and inevitable impurities. The impurities have a total content less than or equal to 0.3%.

The present disclosure further provides a preparation method of the high-plasticity rapidly-degradable Mg—Li—Gd—Ni alloy, including the following steps.

1) Pre-treatment: surfaces of an industrial pure Mg ingot, a Mg—Li master alloy, a Mg—Gd master alloy, and a Mg—Ni master alloy are polished to remove an oxide layer from the surfaces, and the polished industrial pure Mg ingot, Mg—Li master alloy, Mg—Gd master alloy, and Mg—Ni master alloy are placed in industrial alcohol in turn, and then placed in an ultrasonic cleaner for cleaning.
2) The pre-treated pure Mg ingot, Mg—Li master alloy, Mg—Gd master alloy, and Mg—Ni master alloy are placed in a crucible based on a proportion of above mass fractions. Then the crucible is placed in a vacuum induction furnace. Vacuumizing is performed to $5.0\times10^{-1}$ Pa. Heating is performed to 730° C. under protection of an argon gas until complete melting. Heat preservation is performed for 10 min. A mixture is stirred evenly. Scum on a surface of a melt is scraped away to obtain an alloy melt. Then the vacuum induction furnace is closed, such that the alloy melt is cooled with a furnace temperature of the vacuum induction furnace to obtain an as-cast alloy.
3) The as-cast alloy obtained in step 2) is placed in a 200° C. heat treatment furnace for pre-extrusion heat treatment for 2 h. Air cooling is performed. Turning machining is performed on the air-cooled as-cast alloy to obtain an extrusion ingot with a diameter of 80 mm and a height of 70 mm.
4) The extrusion ingot in step 3) is subjected to preheating treatment at 260° C. for 20 min, and then subjected to extrusion forming in an extruder with an extrusion temperature of 250° C., an extrusion ratio of 50:1, and an extrusion speed of 2 m/min to obtain an extruded Mg—Li—Gd—Ni alloy rod.

In the present embodiment, the properties of the prepared high-plasticity rapidly-degradable Mg—Li—Gd—Ni alloy are tested, and the results are as follows: the alloy has a tensile strength of 209 MPa, a yield strength of 166 MPa, an elongation of 35%, and a degradation rate of 38 mg/cm$^2$/h in a 3 wt % KCl solution at 93° C.

Embodiment 9

A high-plasticity rapidly-degradable Mg—Li—Gd—Ni alloy includes the following chemical elements by mass percentage: 8.0% of Gd, 2.0% of Ni, 8% of Li, and the rest of Mg and inevitable impurities. The impurities have a total content less than or equal to 0.3%.

The present disclosure further provides a preparation method of the high-plasticity rapidly-degradable Mg—Li—Gd—Ni alloy, including the following steps.

1) Pre-treatment: surfaces of an industrial pure Mg ingot, a Mg—Li master alloy, a Mg—Gd master alloy, and a Mg—Ni master alloy are polished to remove an oxide layer from the surfaces, and the polished industrial pure Mg ingot, Mg—Li master alloy, Mg—Gd master alloy, and Mg—Ni master alloy are placed in industrial alcohol in turn, and then placed in an ultrasonic cleaner for cleaning.
2) The pre-treated pure Mg ingot, Mg—Li master alloy, Mg—Gd master alloy, and Mg—Ni master alloy are placed in a crucible based on a proportion of above mass fractions. Then the crucible is placed in a vacuum induction furnace. Vacuumizing is performed to $5.0\times10^{-1}$ Pa. Heating is performed to 730° C. under protection of an argon gas until complete melting. Heat preservation is performed for 10 min. A mixture is stirred evenly. Scum on a surface of a melt is scraped away to obtain an alloy melt. Then the vacuum induction furnace is closed, such that the alloy melt is cooled with a furnace temperature of the vacuum induction furnace to obtain an as-cast alloy.
3) The as-cast alloy obtained in step 2) is placed in a 200° C. heat treatment furnace for pre-extrusion heat treatment for 2 h. Air cooling is performed. Turning machining is performed on the air-cooled as-cast alloy to obtain an extrusion ingot with a diameter of 80 mm and a height of 70 mm.
4) The extrusion ingot in step 3) is subjected to preheating treatment at 260° C. for 20 min, and then subjected to extrusion forming in an extruder with an extrusion temperature of 250° C., an extrusion ratio of 50:1, and an extrusion speed of 2 m/min to obtain an extruded Mg—Li—Gd—Ni alloy rod.

In the present embodiment, the properties of the prepared high-plasticity rapidly-degradable Mg—Li—Gd—Ni alloy are tested, and the results are as follows: the alloy has a tensile strength of 205 MPa, a yield strength of 146 MPa, an elongation of 40%, and a degradation rate of 105 mg/cm$^2$/h in a 3 wt % KCl solution at 93° C.

Comparative Example 1

In this comparative example, a high-plasticity rapidly-degradable Mg—Li—Ni alloy is designed. The composition of the alloy is basically the same as that of Embodiment 5, except that it does not contain a Gd element, and a preparation method of the high-plasticity rapidly-degradable Mg—Li—Ni alloy is the same as that of Embodiment 5.

In the present embodiment, the properties of the prepared high-plasticity rapidly-degradable Mg—Li—Gd—Ni alloy are tested, and the results are as follows: the alloy has a tensile strength of 141 MPa, a yield strength of 103 MPa, an elongation of 33%, and a degradation rate of 38 mg/cm$^2$/h in a 3 wt % KCl solution at 93° C.

Comparative Example 2

In this comparative example, a high-plasticity Mg—Li—Gd alloy is designed. The composition of the alloy is basically the same as that of Embodiment 5, except that it does not contain a Ni element, and a preparation method of the high-plasticity rapidly-degradable Mg—Li—Gd alloy is the same as that of Embodiment 5.

In the present embodiment, the properties of the prepared high-plasticity rapidly-degradable Mg—Li—Gd—Ni alloy are tested, and the results are as follows: the alloy has a tensile strength of 197 MPa, a yield strength of 149 MPa, an elongation of 30%, and a degradation rate of 3 mg/cm$^2$/h in a 3 wt % KCl solution at 93° C.

Finally, it should be noted that the above embodiments are provided merely for describing the technical solutions of the present disclosure, but not for limiting the present disclosure. Although the present disclosure is described in detail with reference to the above embodiments, a person of ordinary skill in the art should understand that they may still make modifications to the technical solutions described in the above embodiments or make equivalent replacements to some or all technical features thereof; and these modifications or replacements do not make the essence of the corresponding technical solution depart from the scope of the technical solutions of the embodiments of the present disclosure, and shall fall within the scope of claims and specification of the present disclosure.

What is claimed is:

1. A high-plasticity rapidly-degradable Mg—Li—Gd—Ni alloy, comprising the following chemical elements by mass percentage: 6.0% of Gd, 8.0% of Li, 1.5% of Ni, and the rest of Mg and inevitable impurities, wherein the impurities have a total content less than or equal to 0.3%.

2. A preparation method of the high-plasticity rapidly-degradable Mg—Li—Gd—Ni alloy according to claim 1, comprising the following technical steps:

A) batching, smelting, and cooling an industrial pure Mg ingot, a Mg—Li master alloy, a Mg—Gd master alloy, and a Mg—Ni master alloy according to above mass fractions to obtain an as-cast alloy;

B) performing pre-extrusion heat treatment, air cooling, and machining on the as-cast alloy obtained in step A) to obtain an extrusion ingot; and C) performing pre-heating treatment and extrusion forming on the extrusion ingot in step B) to obtain an extruded Mg—Li—Gd—Ni alloy rod.

3. The preparation method of the high-plasticity rapidly-degradable Mg—Li—Gd—Ni alloy according to claim 2, comprising the following chemical elements by mass percentage: 6.0% of Gd, 8.0% of Li, 0.5% of Ni, and the rest of Mg and inevitable impurities, wherein the impurities have a total content less than or equal to 0.3%.

4. The preparation method of the high-plasticity rapidly-degradable Mg—Li—Gd—Ni alloy according to claim 2, further comprising pre-treatment, wherein a process of pre-treatment comprises polishing surfaces of the industrial pure Mg ingot, the Mg—Li master alloy, the Mg—Gd master alloy, and the Mg—Ni master alloy, placing the polished industrial pure Mg ingot, Mg—Li master alloy, Mg—Gd master alloy, and Mg—Ni master alloy in industrial alcohol in turn, and then placing the polished industrial pure Mg ingot, Mg—Li master alloy, Mg—Gd master alloy, and Mg—Ni master alloy in an ultrasonic cleaner for cleaning.

5. The preparation method of the high-plasticity rapidly-degradable Mg—Li—Gd—Ni alloy according to claim 2, wherein a process of step A) specifically comprises: placing the pure Mg ingot, the Mg—Li master alloy, the Mg—Gd master alloy, and the Mg—Ni master alloy in a crucible based on a proportion of the above mass fractions, placing the crucible in a vacuum induction furnace, vacuumizing to $5.0\times10^{-1}$ Pa, heating to 730° C. under protection of an argon gas until complete melting, performing heat preservation for 10 min, stirring evenly, and scraping away scum on a surface of a melt to obtain an alloy melt; and then closing the vacuum induction furnace, such that the alloy melt is cooled with a furnace temperature of the vacuum induction furnace to obtain the as-cast alloy.

6. The preparation method of the high-plasticity rapidly-degradable Mg—Li—Gd—Ni alloy according to claim 2, wherein a process of step B) specifically comprises: placing the as-cast alloy obtained in step A) in a 200° C. heat treatment furnace for pre-extrusion heat treatment for 2 h, performing air cooling, and performing turning machining on the air-cooled as-cast alloy to obtain the extrusion ingot with a diameter of 80 mm and a height of 70 mm.

7. The preparation method of the high-plasticity rapidly-degradable Mg—Li—Gd—Ni alloy according to claim 2, wherein the pre-heating treatment is performed at 260° C. for 20 min.

8. The preparation method of the high-plasticity rapidly-degradable Mg—Li—Gd—Ni alloy according to claim 7, wherein the extrusion forming is performed with an extrusion ratio of (28-50):1 at 1-3 m/min and 200-300° C.

* * * * *